US010352656B2

(12) United States Patent
Ding et al.

(10) Patent No.: US 10,352,656 B2
(45) Date of Patent: Jul. 16, 2019

(54) FIREARM RAIL WITH EXPANDING MOUNTING LEGS

(71) Applicant: Leapers, Inc., Livonia, MI (US)

(72) Inventors: Tai-Lai Ding, Northville, MI (US); Tat Shing Yu, Plymouth, MI (US)

(73) Assignee: Leapers, Inc., Livonia, MI (US)

( * ) Notice: Subject to any disclaimer, the term of this patent is extended or adjusted under 35 U.S.C. 154(b) by 0 days.

(21) Appl. No.: 15/385,583

(22) Filed: Dec. 20, 2016

(65) Prior Publication Data

US 2017/0299337 A1 Oct. 19, 2017

Related U.S. Application Data

(60) Provisional application No. 62/279,253, filed on Jan. 15, 2016.

(51) Int. Cl.
*F41A 15/00* (2006.01)
*F41G 11/00* (2006.01)

(52) U.S. Cl.
CPC ..... *F41G 11/003* (2013.01); *F41G 11/004* (2013.01)

(58) Field of Classification Search
CPC ..... F41G 11/003
USPC ..... 42/90
See application file for complete search history.

(56) References Cited

U.S. PATENT DOCUMENTS 4,446,644 A 5/1984 Jimenez et al.
5,784,822 A * 7/1998 Korapaty ..... F41G 11/004 42/124
5,926,964 A * 7/1999 Korapaty ..... F41G 11/003 42/124
6,393,752 B1 5/2002 Oliver et al.
8,752,325 B2 6/2014 Ding et al.
8,800,195 B2 * 8/2014 LaFrance ..... F41G 11/001 42/114
8,898,949 B1 12/2014 Greenwood
9,671,198 B2 * 6/2017 Bartoszewicz ..... F41G 11/003
9,677,854 B1 6/2017 Tran
2011/0283590 A1 11/2011 Chiang
2012/0159831 A1 * 6/2012 LaFrance ..... F41G 11/001 42/90

(Continued)

FOREIGN PATENT DOCUMENTS

GB 2487835 A 8/2012
WO WO-2011085295 A1 7/2011

OTHER PUBLICATIONS

Chinese Office Action for Application No. 201610026365.0 dated Nov. 23, 2016.

(Continued)

*Primary Examiner* — Samir Abdosh
(74) *Attorney, Agent, or Firm* — Honigman LLP

(57) ABSTRACT

A mounting system includes a bracket, a first engagement member, and a second engagement member. The bracket includes a first leg, a second leg, and a bridge portion extending between the first leg and the second leg. The first leg defines a first aperture. The second leg defines a second aperture. The first engagement member is disposed within the first aperture and includes a first engagement surface. The second engagement member is disposed within the second aperture and includes a second engagement surface configured to receive the first engagement surface.

20 Claims, 6 Drawing Sheets

(56) References Cited

U.S. PATENT DOCUMENTS

| | | | | |
|---|---|---|---|---|
| 2015/0068094 | A1 | 3/2015 | Seuk | |
| 2015/0300775 | A1* | 10/2015 | Combs | F41C 23/16 42/72 |

OTHER PUBLICATIONS

BKL-568 4 Long Dovetail to Weaver/Picatinny Adaptor Mount, BKL Tech website, [online], [site visited Dec. 20, 2016]. <URL: http://www.bkltech.com/BKL-4-Dovetail-to-Weaver-Adaptor-p/bkl-568.htm>.

European Search Report for Application No. EP 17151481 dated Jun. 28, 2017.

* cited by examiner

FIREARM RAIL WITH EXPANDING MOUNTING LEGS

CROSS REFERENCE TO RELATED APPLICATIONS

This U.S. patent application claims priority under 35 U.S.C. § 119(e) to U.S. Provisional Application 62/279,253, filed on Jan. 15, 2016. The disclosure of this prior application is considered part of the disclosure of this application and is hereby incorporated by reference in its entirety.

FIELD

The present disclosure relates generally to a firearm rail, and more particularly to a firearm rail having expanding mounting legs.

BACKGROUND

This section provides background information related to the present disclosure and is not necessarily prior art.

Firearms, such as rifles, shotguns, pistols, and crossbows, for example, often include a rail or rail mount system that allows a user to mount various accessories to the firearm. For example, the rail may allow the user to mount a sight, a grip, a light, and/or a magazine to the firearm. Such rails may include, or otherwise define, a mounting profile such as a "Weaver" mounting profile or a "Picatinny" mounting, for example. In some cases, it may be desirable to convert a rail from one profile (e.g., Weaver mounting profile) to another profile (e.g., a Picatinny mounting profile).

While known rails and rail mount systems have proven acceptable for their intended purposes, a continuous need for improvement in the pertinent art remains.

SUMMARY

This section provides a general summary of the disclosure, and is not a comprehensive disclosure of its full scope or all of its features.

One aspect of the disclosure provides a mounting system. The mounting system may include a bracket, a first engagement member, and a second engagement member. The bracket may include a first leg, a second leg, and a bridge portion extending between the first leg and the second leg. The first leg may define a first aperture. The second leg may define a second aperture. The first engagement member may be disposed within the first aperture and may include a first engagement surface. The second engagement member may be disposed within the second aperture and may include a second engagement surface configured to receive the first engagement surface.

Implementations of the disclosure may include one or more of the following optional features. In some implementations, the first engagement member extends along a first axis and the second engagement member extends along a second axis collinear with the first axis. The first engagement surface may be symmetrically disposed about the first axis and the second engagement surface may be symmetrically disposed about the second axis.

In some implementations, the first aperture is defined by a first wall surrounding a first central axis, and the second aperture is defined by a second wall surrounding a second central axis collinear with the first central axis. The first engagement member may extend along a third axis and the second engagement member extend along a fourth axis. The third and fourth axes may be collinear with the first and second axes. In some implementations, the first engagement member is threadedly coupled to the first leg. In some implementations, the first wall defines a first diameter and the second wall defines a second diameter greater than the first diameter.

In some implementations, the first engagement surface is convex and the second engagement surface is concave.

In some implementations, the first engagement member is threadedly coupled to the first leg. The second engagement member may be threadedly coupled to the second leg.

In some implementations, the first and second engagement members are operable to bias the first leg away from the second leg.

In some implementations, the first leg defines a third aperture and the second leg defines a fourth aperture. The mounting system may also include a third engagement member and a fourth engagement member. The third engagement member may be disposed within the third aperture and may include a third engagement surface. The fourth engagement member may be disposed within the fourth aperture and may include a fourth engagement surface configured to receive the third engagement surface. In some implementations, the first engagement member extends along a first axis and the second engagement member extends along a second axis. The third engagement member may extend along a third axis, and the fourth engagement member may extend along a fourth axis. In some implementations, the first axis is collinear with the second axis, and the third axis is collinear with the fourth axis.

In a first orientation, the first leg may be separated from the second leg by (i) a first distance along the first and second axes and (ii) a second distance along the third and fourth axes. The first distance may be equal to the second distance. In a second orientation, the first leg may be separated from the second leg by (iii) a third distance along the first and second axes and (iv) a fourth distance along the third and fourth axes. The third distance may be equal to the fourth distance. The third and fourth distances may be greater than the first and second distances.

Another aspect of the disclosure provides a firearm mounting system. The firearm mounting system may include a bracket having a first leg, a second leg, and a bridge portion. The first leg may define a first aperture concentrically surrounding a first axis and defining a first diameter. The second leg may define a second aperture concentrically surrounding a second central axis collinear with the first central axis and defining a second diameter greater than the first diameter. The bridge portion may extend between the first leg and the second leg to define a channel extending between the first leg, the second leg, and the bridge portion.

This aspect may include one or more of the following optional features. In some implementations, the firearm mounting system includes a first engagement member extending along a third axis and a second engagement member extending along a fourth axis collinear with the third axis. The first engagement member may include a first engagement surface symmetrically disposed about the third axis. The second engagement member may include a second engagement surface symmetrically disposed about the fourth axis.

In some implementations, the third and fourth axes are collinear with the first and second axes. The first engagement surface may be convex and the second engagement surface may be concave.

Another aspect of the disclosure provides a method of operating a mounting system for a firearm. The method may include positioning a first fastener within a first aperture of a first leg, and positioning a second fastener within a second aperture of a second leg. The second leg may be opposite the first leg. The method may also include engaging the first fastener with the second fastener, applying a first force on the first leg with the first fastener, and applying a second force on the second leg with the second fastener. The second force may be opposite the first force. The method may further include positioning the first fastener within the first aperture and within the second aperture. The method may also include applying a third force on the first leg with the first fastener and applying a fourth force on the second leg with the first fastener. The third force may be opposite the first force. The fourth force may be opposite the second force.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected configurations and not all possible implementations, and are not intended to limit the scope of the present disclosure.

Corresponding reference numerals indicate corresponding parts throughout the drawings.

DETAILED DESCRIPTION

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

Figure 1:
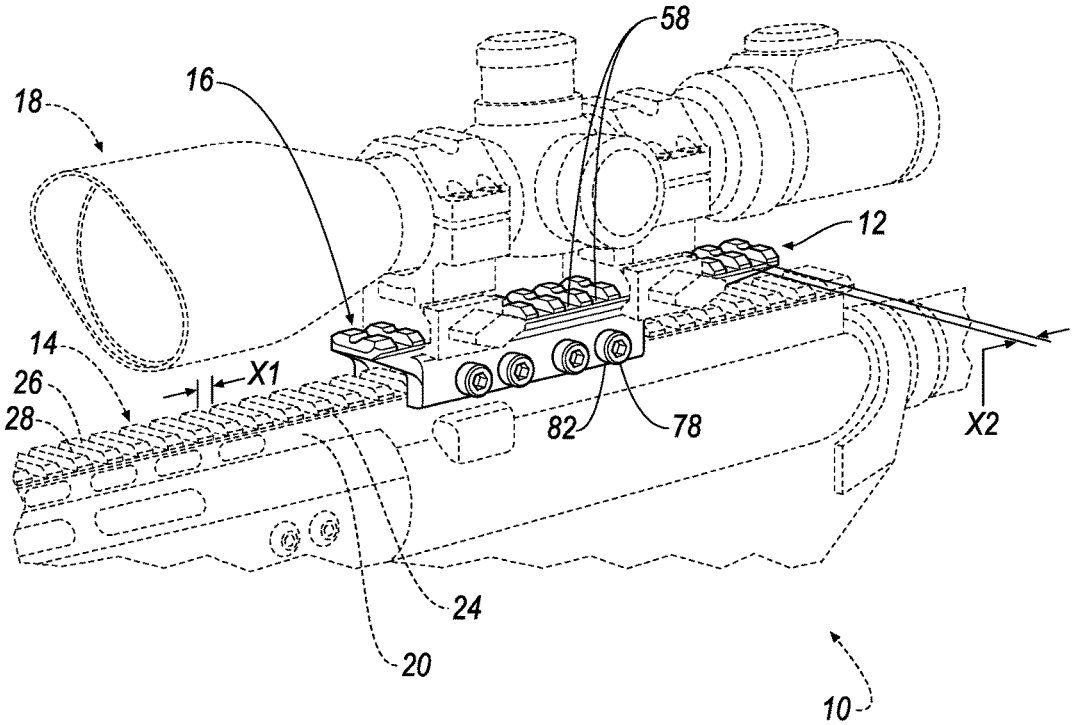
FIG. 1 is a perspective view of a firearm having a rail in accordance with the principles of the present disclosure.

With reference to FIG. 1, a firearm 10 including a rail mount system 12 is provided. The firearm 10 may include a gun (e.g., rifle, shotgun, pistol, etc.) or a bow (e.g., crossbow) within the scope of the present disclosure. The rail mount system 12 may be supported by the firearm 10 and may include a primary mounting system 14, a secondary mounting system 16, and an accessory 18 such as a sight, a grip, a light, and/or a magazine.

The primary mounting system 14 may be coupled to the firearm 10 and may include or otherwise define a primary mounting bracket 20. The primary mounting bracket 20 may include one of a Picatinny system, a Weaver system, or any other system known to those of skill in the art. In this regard, the primary mounting bracket 20 may include a first mounting profile 24 and a second mounting profile 26. The first mounting profile 24 may define a dovetail or other suitable mounting profile. The second mounting profile 26 may define a plurality of mounting features 28 (e.g., grooves, protrusions, apertures, etc.) defining a primary distance X1 extending therebetween.

Figure 2:
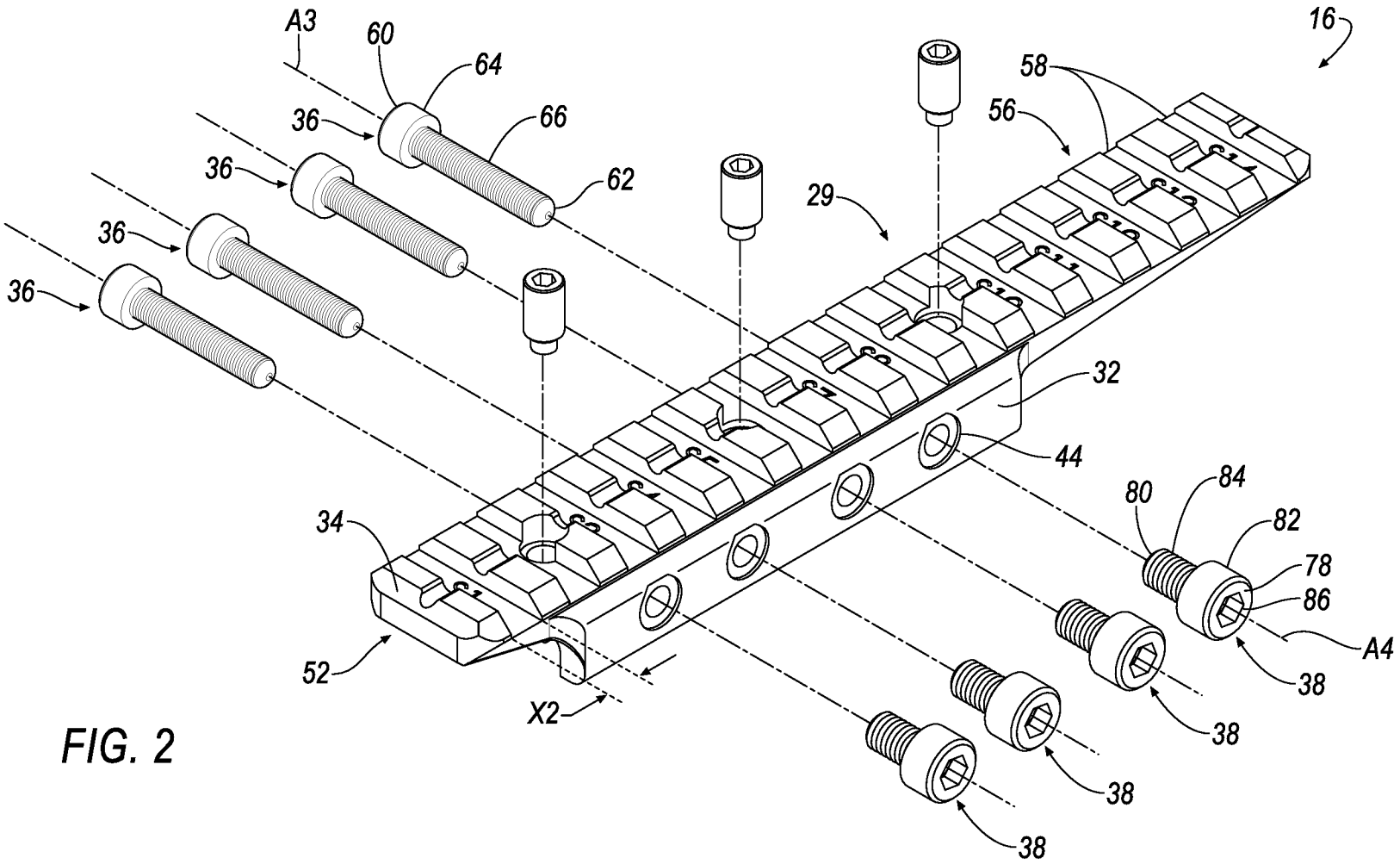
FIG. 2 is an exploded top perspective view of a rail in accordance with the principles of the present disclosure.
Figure 3:
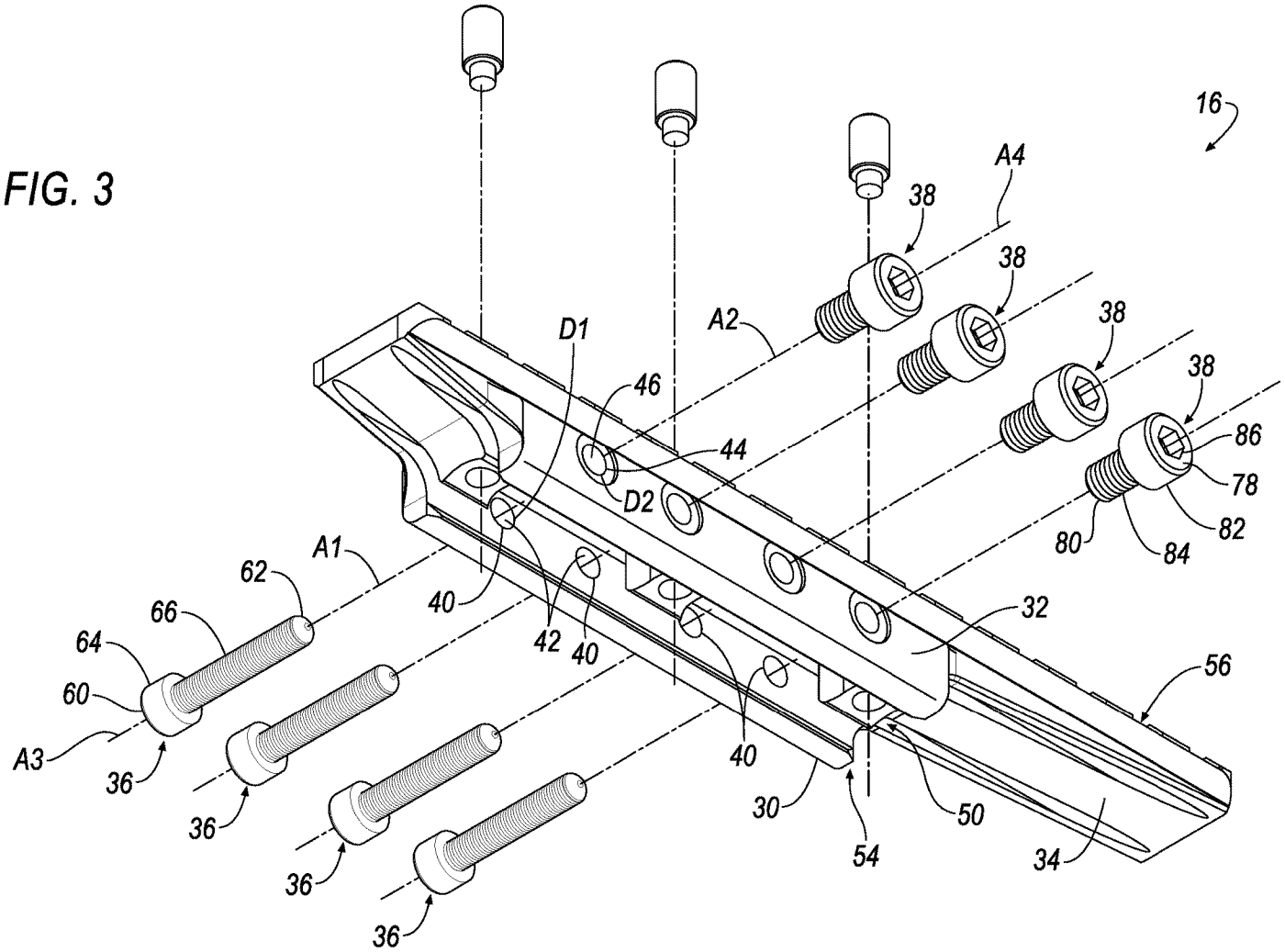
FIG. 3 is an exploded bottom perspective view of the rail of FIG. 2.

With reference to FIGS. 2 and 3, the secondary mounting system 16 may be selectively coupleable to the primary mounting system 14 and may include a bracket 29, one or more first engagement members 36, and one or more second engagement members 38. As will be described in more detail below, the first and second engagement members 36, 38 may be selectively coupleable to the bracket 29.

The bracket 29 may include a first leg 30, a second leg 32, a bridge portion 34. In some implementations, the first leg 30, the second leg 32, and the bridge portion 34 define an integral and/or monolithic construct.

The first leg 30 may include one or more first apertures 40 (FIG. 3). As illustrated, in some implementations, the first leg 30 includes four equally-spaced first apertures 40. It will be appreciated, however, that the first leg 30 may include more or less than four first apertures 40 within the scope of the present disclosure. The first apertures 40 may extend through the first leg 30. In some implementations, one or more of the first apertures 40 is defined by a threaded wall 42 having a first diameter D1 and surrounding a first central axis A1.

The second leg 32 may include one or more second apertures 44. The second apertures 44 may extend through the second leg 32. In some implementations, one or more of the second apertures 44 is defined by a threaded wall 46 having a second diameter D2 and surrounding a second central axis A2. The second diameter D2 of the second apertures 44 may be greater than the first diameter D1 of the first apertures 40. As illustrated, in some implementations, the second leg 32 includes four equally-spaced second apertures 44. It will be appreciated, however, that the second leg 32 may include more or less than four second apertures 44 within the scope of the present disclosure. In this regard, the number of second apertures 44 may be equal to the number of first apertures 40. In some implementations, each second aperture 44 is substantially aligned with one of the first apertures 40. For example, the first central axis A1 may extend in a direction substantially parallel (+/−5 degrees) to the second central axis A2. In some implementations, the first central axis A1 is aligned (e.g., collinear) with the second central axis A2.

The first leg 30, the second leg 32, and the bridge portion 34 may collectively define a channel 50. In this regard, the bridge portion 34 may connect the first leg 30 to the second leg 32 such that the first apertures 40 and the second apertures 44 are in fluid communication with the channel 50. In particular, the bridge portion 34 may extend from and between the first leg 30 and the second leg 32 such that the first leg 30 and the second leg 32 extend away from the bridge portion 34 in a direction substantially parallel to one another.

The first leg 30, the second leg 32, and/or the bridge portion 34 may define a secondary mounting system 52. The secondary mounting system 52 may include one of a Picatinny system, a Weaver system, or any other system known to those of skill in the art. In this regard, the secondary mounting system 52 may define a first mounting profile 54 and a second mounting profile 56. The first mounting profile 54 may be defined within the channel 50, and may be complementary to the first mounting profile 24 of the primary mounting bracket 20. In this regard, as will be explained in more detail below, in an assembled configuration, the secondary mounting system 16 may be disposed within the channel 50 such that the first mounting profile 24 of the primary mounting bracket 20 is received by the first mounting profile 54 of the secondary mounting system 16.

The bridge portion 34 may further define the second mounting profile 56. In some implementations, the second mounting profile 56 of the bridge portion 34 is different than the second mounting profile 26 of the primary mounting bracket 20. For example, the second mounting profile 56 of the bridge portion 34 may define a plurality of mounting features 58 (e.g., grooves, protrusions, apertures, etc.) defining a secondary distance X2 extending therebetween. The secondary distance X2 defined by and/or between the mounting features 58 of the second mounting profile 56 may be greater than or less than the primary distance X1 defined by and/or between the mounting features 28 of the second mounting profile 26 of the primary mounting bracket 20.

As illustrated in FIGS. 2 and 3, in some implementations, the secondary mounting system 16 includes four first engagement members 36. It will be appreciated, however, that the secondary mounting system 16 may include more or less than four first engagement members 36 within the scope of the present disclosure. In this regard, the number of first engagement members 36 may equal the number of first apertures 40.

Figure 4:
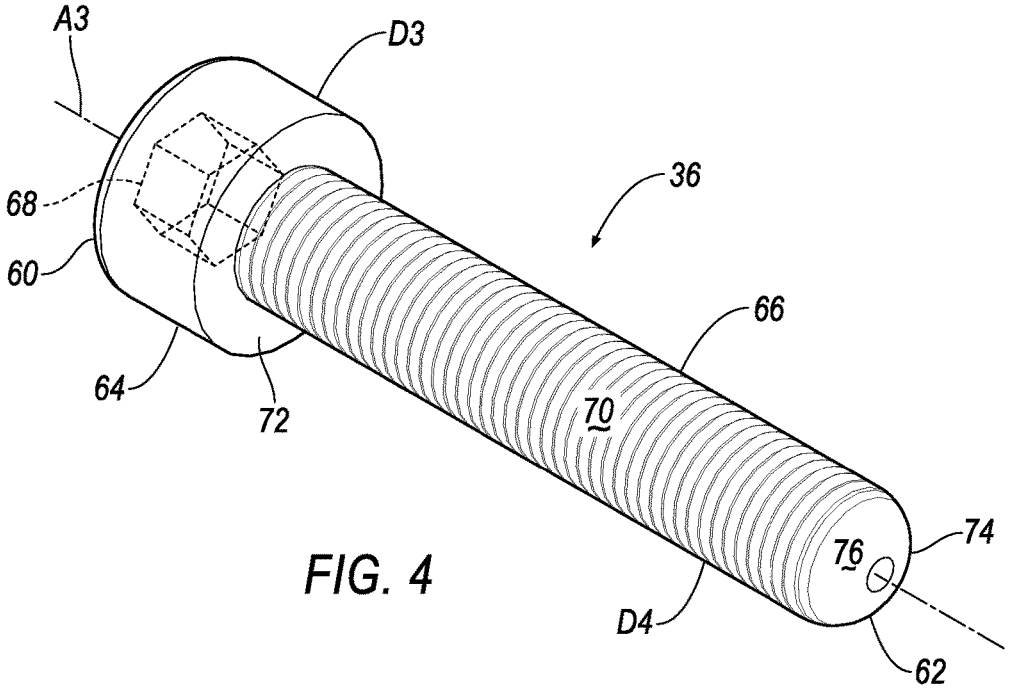
FIG. 4 is a perspective view of a first fastener for use with a rail in accordance with the principles of the present disclosure.

With reference to FIG. 4, each first engagement member 36 may extend along a respective first engagement axis A3 from a proximal end 60 to a distal end 62. The first engagement member 36 may include a head portion 64 extending along the first engagement axis A3 from the proximal end 60, and a shaft portion 66 extending along the first engagement axis A3 from the head portion 64 to the distal end 62. In this regard, first engagement axis A3 may be centrally located within the head portion 64 and/or the shaft portion 66.

The head portion 64 may include a driving feature 68. For example, in some implementations, the head portion 64 defines a substantially cylindrical construct having a head diameter D3 and a driving feature 68 disposed at the proximal end 60 of the first engagement member 36. In this regard, the driving feature 68 may define a recess (e.g., a slot, a cross-recess, or a hex socket) formed in the proximal end 60 for receiving a driving tool (e.g., a screwdriver or an Allen wrench). It will be appreciated, however, that the driving feature 68 may include other forms within the scope of the present disclosure. For example, in some implementations, the driving feature 68 may include a polygonally-shaped (e.g., hexagonal) outer surface of the head portion 64.

The shaft portion 66 may include a threaded outer surface 70 defining a shaft diameter D4. The threaded outer surface 70 may be sized and shaped to threadably engage the threaded wall 42 defining the first apertures 40 of the first leg 30. The shaft diameter D4 may be less than the head diameter D3 such that the head portion 64 defines a shoulder 72 relative to the shaft portion 66.

The distal end 62 of the first engagement member 36 may include a first engagement feature 74. The first engagement feature 74 may be symmetrically disposed about the first engagement axis A3. In some implementations, the first engagement feature 74 includes a convex engagement surface 76 defining a first radius of curvature.

As illustrated in FIGS. 2 and 3, in some implementations, the secondary mounting system 16 includes four second engagement members 38. It will be appreciated, however, that the secondary mounting system 16 may include more or less than four second engagement members 38 within the scope of the present disclosure. In this regard, the number of second engagement members 38 may equal the number of first engagement members 36 and/or the number of second apertures 44.

Figure 5:
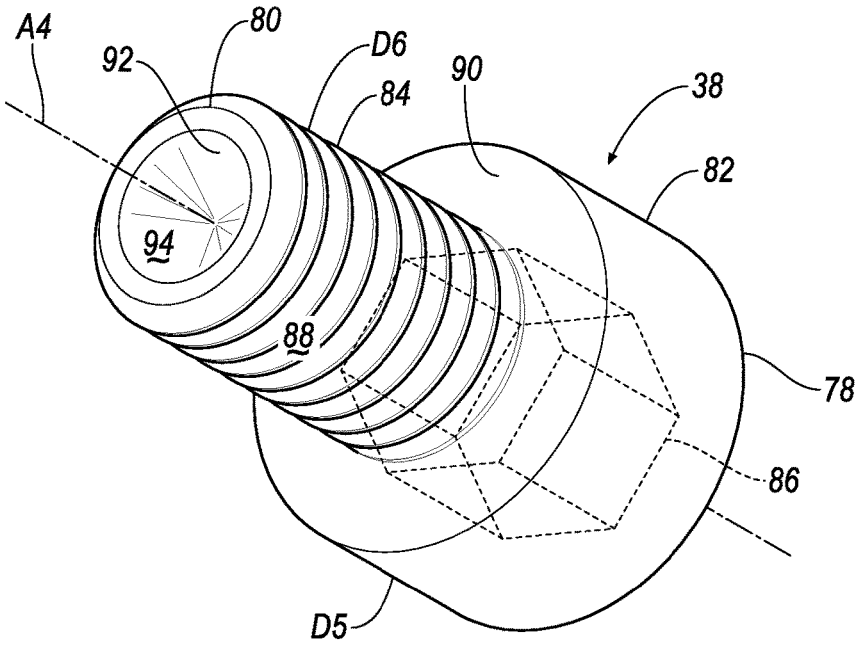
FIG. 5 is a perspective view of a second fastener for use with a rail in accordance with the principles of the present disclosure.

With reference to FIG. 5, each second engagement member 38 may extend along a second engagement axis A4 from a proximal end 78 to a distal end 80. The second engagement member 38 may include a head portion 82 extending along the second engagement axis A4 from the proximal end 78, and a shaft portion 84 extending along the second engagement axis A4 from the head portion 82 to the distal end 80. In this regard, second engagement axis A4 may be centrally located within the head portion 82 and/or the shaft portion 84.

The head portion 82 may include a driving feature 86. For example, in some implementations, the head portion 82 defines a substantially cylindrical construct having a head diameter D5 and a driving feature 86 disposed at the proximal end 80 of the second engagement member 38. In this regard, the driving feature 86 may define a recess (e.g., a slot, a cross-recess, or a hex socket) formed in the proximal end 80 for receiving a driving tool (e.g., a screwdriver or an Allen wrench). It will be appreciated, however, that the driving feature 86 may include other forms within the scope of the present disclosure. For example, in some implementations, the driving feature 86 may include a polygonally-shaped (e.g., hexagonal) outer surface of the head portion 82.

The shaft portion 84 may include a threaded outer surface 88 defining a shaft diameter D6. The threaded outer surface 88 may be sized and shaped to threadably engage the threaded wall 46 defining the second apertures 44 of the second leg 32. The shaft diameter D6 may be less than the head diameter D5 such that the head portion 82 defines a shoulder 90 relative to the shaft portion 84.

The distal end 80 of the second engagement member 38 may include a second engagement feature 92. The second engagement feature 92 may be symmetrically disposed about the second engagement axis A4. In some implementations, the second engagement feature 92 includes a concave engagement surface 94 defining a first radius of curvature. The first radius curvature of the concave engagement surface 94 may be substantially equal to the first radius of curvature of the convex engagement surface 76 of the first engagement feature 74. In particular, the first engagement feature 74 of the first engagement member 36 may be sized and shaped to mate with the second engagement feature 92 of the second engagement member 38. In this regard, while the first engagement feature 74 is generally shown and described herein as having a convex engagement surface 76, and the second engagement feature 92 is generally shown and described herein as having a concave engagement surface 94, it will be appreciated that the first engagement feature 74 may include a concave surface, and the second engagement feature 92 may include a convex surface sized and shaped to mate with the concave surface of the first engagement feature 74, within the scope of the present disclosure.

Figure 6A:
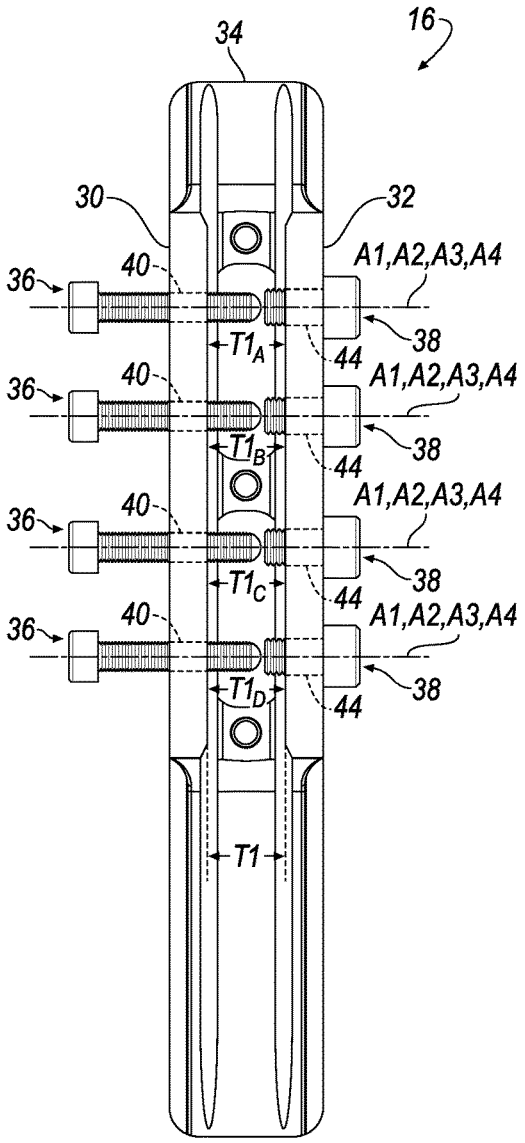
FIG. 6A is a bottom view of the rail of FIG. 2 in a retracted position during a method of use in accordance with the principles of the present disclosure.
Figure 6B:
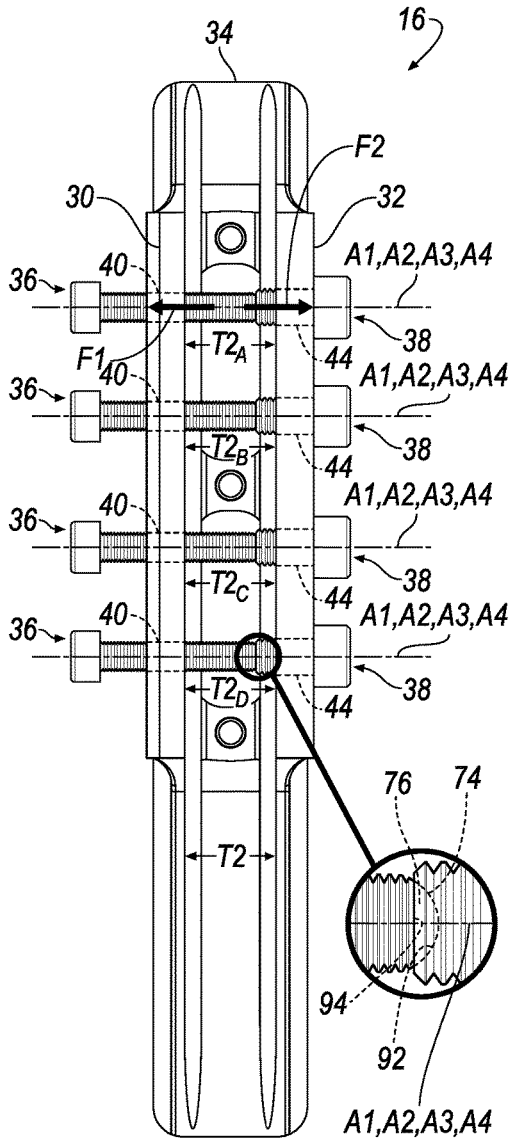
FIG. 6B is a bottom view of the rail of FIG. 2 in an expanded position during a method of use in accordance with the principles of the present disclosure.

With reference to FIGS. 1 and 6A-6D, a method of using or otherwise operating the rail mount system 12, including the secondary mounting system 16, will now be described. As illustrated in FIGS. 6A and 6B, during first and second stages of operation, the first engagement member 36 may be disposed within one of the first apertures 40 of the first leg 30, and the second engagement member 38 may be disposed within one of the second apertures 44 of the second leg 32, such that the shaft portions 66, 84 of the first and/or second engagement members 36, 38 are disposed within the channel 50. For example, the threaded outer surface 70 of the first engagement member 36 may be threadably engaged with the threaded wall 42 defining the first apertures 40 of the first leg 30, and the threaded outer surface 88 of the second engagement member 38 may be threadably engaged with the threaded wall 46 defining the second apertures 44 of the second leg 32. In the assembled configuration, the first and second engagement axes A3, A4 may be substantially aligned (e.g., collinear) with the first and second central axes A1, A2 of the first and second apertures 40, 44. In this regard, the first and second engagement features 74, 92 may be symmetrically disposed about the first and second central axes A1, A2 of the first and second apertures 40, 44.

With particular reference to FIG. 6A, during a first stage of operation, the first leg 30 and the second leg 32 may assume a first orientation and define a distance T1 extending therebetween. The distance T1 may be extend in a direction substantially parallel to the central axes A1, A2 of the first and second apertures 40, 44. In particular, the first leg 30 and the second leg 32 may define (i) a first distance $T1_A$ extending therebetween proximate, and/or measured along, respective first and second central axes A1, A2 of a first pair of the first and second apertures 40, 44, (ii) a second distance $T1_B$ extending therebetween proximate, and/or measured along, respective first and second central axes A1, A2 of a second pair of the first and second apertures 40, 44, (iii) a third distance $T1_C$ extending therebetween proximate, and/or measured along, respective first and second central axes A1, A2 of a third pair of the first and second apertures 40, 44, (iv) a fourth distance $T1_D$ extending therebetween proximate, and/or measured along, respective first and second central axes A1, A2 of a fourth pair of the first and second apertures 40, 44. The first, second, third, and fourth distances $T1_A$, $T1_B$, $T1_C$, $T1_B$ may be substantially equal to one another, such that the first leg 30 is substantially parallel to the second leg 32, and the first and second legs 30, 32 are substantially orthogonal to the first and second engagement axes A3, A4 and to the first and second central axes A1, A2 of the first and second apertures 40, 44.

With particular reference to FIG. 6B, during a second stage of operation, a user may move the first engagement member 36 toward the second engagement member 38. In this regard, the user may move the first and/or second engagement member 36, 38 in a direction substantially parallel to the central axes A1, A2 of the first and second apertures 40, 44. For example, the user may rotate the first and/or second engagement members 36, 38 to threadably engage the threaded outer surface 70 of the first engagement member 36 with the threaded wall 42 defining the first apertures 40 of the first leg 30, and/or threadably engage the threaded outer surface 88 of the second engagement member 38 with the threaded wall 46 defining the second apertures 44 of the second leg 32.

As the user rotates the first and/or second engagement members 36, 38, the first engagement feature 74 of the first engagement member 36 may engage the second engagement feature 92 of the second engagement member 38. In this regard, the first and/or second engagement feature 74, 92 may rotate about the central axes A1, A2 of the first and second apertures 40, 44 as the first engagement feature 74 slidably engages the second engagement feature 92.

As the first engagement feature 74 engages the second engagement feature 92, the first and second engagement members 36, 38 may apply equal and opposite forces F1, F2 on the first and second legs 30, 32. The forces F1, F2 may both extend in a direction substantially parallel to the central axes A1, A2 of the first and second apertures 40, 44, causing (e.g., biasing) at least one of the first and second legs 30, 32 to move away from the other of the first and second legs 30, 32, such that the first leg 30 and the second leg 32 assume a second orientation and define a distance T2 extending therebetween. In particular, the first leg 30 and the second leg 32 may define (i) a first distance $T2_A$ extending therebetween proximate, and/or measured along, respective first and second central axes A1, A2 of the first pair of the first and second apertures 40, 44, (ii) a second distance $T2_B$ extending therebetween proximate, and/or measured along, respective first and second central axes A1, A2 of the second pair of the first and second apertures 40, 44, (iii) a third distance $T2_C$ extending therebetween proximate, and/or measured along, respective first and second central axes A1, A2 of the third pair of the first and second apertures 40, 44, (iv) a fourth distance $T2_D$ extending therebetween proximate, and/or measured along, respective first and second central axes A1, A2 of the fourth pair of the first and second apertures 40, 44. The first, second, third, and fourth distances $T2_A$, $T2_B$, $T2_C$, $T2_D$ may be substantially equal to one another, such that the first leg 30 is substantially parallel to the second leg 32, and the first and second legs 30, 32 are substantially orthogonal to the first and second engagement axes A3, A4 and to the first and second central axes A1, A2 of the first and second apertures 40, 44.

The forces F1, F2 may cause the first and/or second legs 30, 32 to bend or otherwise resiliently flex (e.g., elastically deform) such that the distance T2 is greater than the distance T1. In particular, the first distance $T2_A$ may be greater than the first distance $T1_A$, the second distance $T2_B$ may be greater than the second distance $T1_B$, the third distance $T2_C$ may be greater than the third distance $T1_C$, and the fourth distance $T2_D$ may be greater than the fourth distance $T2_D$.

After utilizing the first and second engagement members 36, 38 to define the distance T2 (e.g., $T2_A$, $T2_B$, $T2_C$, $T2_D$), the user may assemble the secondary mounting system 16 to the primary mounting system 14. For example, the user may assemble the secondary mounting system 16 to the first mounting profile 24 (e.g., dovetail) of the primary mounting bracket 20, such that the first and second legs 30, 32 are disposed on opposite sides of the first mounting bracket 20.

Figure 6C:
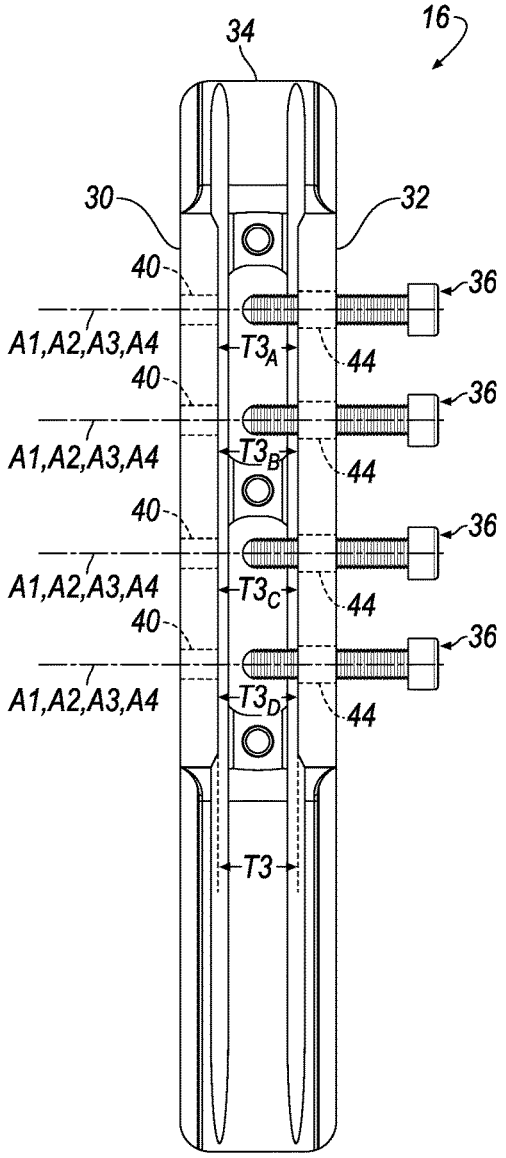
FIG. 6C is a bottom view of the rail of FIG. 2 in an expanded position during a method of use in accordance with the principles of the present disclosure.

With particular reference to FIG. 6C, during a third stage of operation, the user may remove the first and second engagement members 36, 38 from the first and second legs 30, 32, respectively, to remove the forces F1, F2. For example, the user may rotate the first and/or second engagement members 36, 38 to threadably disengage the first and/or second engagement members 36, 38 from the first and second apertures 40, 44 of the first and second legs 30, 32, respectively, to remove the forces F1, F2. Removal of the forces F1, F2 may cause the first or second leg 30, 32 to move towards the other of the first or second leg 30, 32, such that the first leg 30 and the second leg 32 assume a third orientation and define a distance T3 extending therebetween. In particular, the first leg 30 and the second leg 32 may define (i) a first distance $T3_A$ extending therebetween proximate, and/or measured along, the respective first and second central axes A1, A2 of the first pair of the first and second apertures 40, 44, (ii) a second distance $T3_B$ extending therebetween proximate, and/or measured along, the respective first and second central axes A1, A2 of the second pair of the first and second apertures 40, 44, (iii) a third distance $T3_C$ extending therebetween proximate, and/or measured along, the respective first and second central axes A1, A2 of the third pair of the first and second apertures 40, 44, (iv) a fourth distance $T3_D$ extending therebetween proximate, and/or measured along, the respective first and second central axes A1, A2 of the fourth pair of the first and second apertures 40, 44.

The distance T3 may be less than the distance T2 and/or greater than the distance T1. In particular, the first distance $T3_A$ may be less than the first distance $T2_A$ and/or greater than the first distance $T1_A$, the second distance $T3_B$ may be less than the second distance $T2_B$ and/or greater than the second distance $T1_B$, the third distance $T3_C$ may be less than the third distance $T2_C$ and/or greater than the third distance $T1_C$, and the fourth distance $T3_D$ may be less than the fourth distance $T3_D$ and/or greater than the fourth distance $T1_D$. In the third orientation, the first and second legs 30, 32 may engage the first mounting bracket 20.

After removing the first and/or second engagement members 36, 38 from the first and/or second apertures 40, 44, the user may position a fastener within the first and second apertures 40, 44. For example, the user may position the first fastener 36 within the second aperture 44. In some implementations, the user may translate the first fastener 36 through the second aperture 44 towards the first leg 30.

Figure 6D:
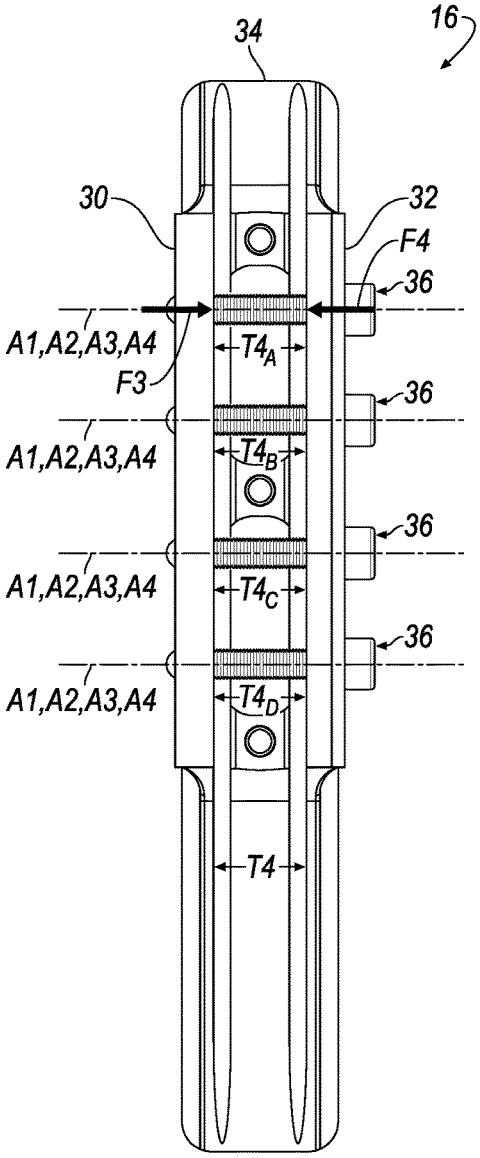
FIG. 6D is a bottom view of the rail of FIG. 2 in an expanded position during a method of use in accordance with the principles of the present disclosure.

With particular reference to FIG. 6D, during a fourth stage of operation, the user may position the first fastener 36 within the first aperture 40 of the first leg 30. For example, the user may rotate the first engagement member 36 to threadably engage the threaded outer surface 70 of the first engagement member 36 with the threaded wall 42 defining the first apertures 40 of the first leg 30. As the first fastener 36 threadably engages the first leg 30, the first fastener 36 may apply equal and opposite forces F3, F4 on the first and second legs 30, 32. For example, shaft portion 66 of the first fastener 36 may apply the force F3 on the first leg 30, and the head portion 64 of the first fastener 36 may apply the force F4 on the second leg 32. The force F3 may be opposite the force F1, and the force F4 may be opposite the force F2.

The forces F3, F4 may both extend in a direction substantially parallel to the central axes A1, A2 of the first and second apertures 40, 44, biasing at least one of the first and second legs 30, 32 toward the other of the first and second legs 30, 32, such that the first leg 30 and the second leg 32 assume a fourth orientation and define a distance T4 extending therebetween. In particular, the first leg 30 and the second leg 32 may define (i) a first distance $T4_A$ extending therebetween proximate, and/or measured along, respective the first and second central axes A1, A2 of the first pair of the first and second apertures 40, 44, (ii) a second distance $T4_B$ extending therebetween proximate, and/or measured along, the respective first and second central axes A1, A2 of the second pair of the first and second apertures 40, 44, (iii) a third distance $T4_C$ extending therebetween proximate, and/or measured along, the respective first and second central axes A1, A2 of the third pair of the first and second apertures 40, 44, (iv) a fourth distance $T4_D$ extending therebetween proximate, and/or measured along, the respective first and second central axes A1, A2 of the fourth pair of the first and second apertures 40, 44. The first, second, third, and fourth distances $T4_A$, $T4_B$, $T4_C$, $T4_D$ may be substantially equal to one another, such that the first leg 30 is substantially parallel to the second leg 32, and the first and second legs 30, 32 are substantially orthogonal to the first and second engagement axes A3, A4 and to the first and second central axes A1, A2 of the first and second apertures 40, 44.

The forces F3, F4 may cause the first and/or second legs 30, 32 to biasingly engage (e.g., squeeze) the first mounting bracket 20 in order to secure the second mounting system 16 relative to the firearm 10. In this regard, in some implementations, the distance T4 may be less than or equal to the distance T3. In particular, the first distance $T4_A$ may be less than or equal to the first distance $T3_A$, the second distance $T4_B$ may be less than or equal to the second distance $T3_B$, the third distance $T4_C$ may be less than or equal to the third distance $T3_C$, and the fourth distance $T4_D$ may be less than or equal to the fourth distance $T3_D$.

As shown and described herein, the configuration of the rail mount system 12, including the configuration of the apertures 40, 44 and the first and second engagement members 36, 38, can make it easier for a user to accurately and correctly couple the secondary mounting system 16 to a firearm (e.g., firearm 10) and/or to a primary mounting system (e.g., primary mounting system 14).

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

What is claimed is:

1. A mounting system comprising:

a bracket having a first leg, a second leg, and a bridge portion extending between the first leg and the second leg, the first leg defining a first aperture, the second leg defining a second aperture;

a first engagement member disposed within the first aperture and having a first engagement surface; and a second engagement member disposed within the second aperture and having a second engagement surface configured to receive the first engagement surface in a non-threaded engagement, wherein the first engagement surface is configured to axially abut the second engagement surface to thereby impart an axial force.

2. The mounting system of claim 1, wherein the first engagement member extends along a first axis and the second engagement member extends along a second axis collinear with the first axis.

3. The mounting system of claim 2, wherein the first engagement surface is symmetrically disposed about the first axis and the second engagement surface is symmetrically disposed about the second axis.

4. The mounting system of claim 1, wherein the first aperture is defined by a first wall surrounding a first central axis, and the second aperture is defined by a second wall surrounding a second central axis collinear with the first central axis.

5. The mounting system of claim 4, wherein the first engagement member extends along a third axis and the second engagement member extends along a fourth axis, the third and fourth axes being collinear with the first and second axes.

6. The mounting system of claim 5, wherein the first engagement member is threadedly coupled to the first leg.

7. The mounting system of claim 6, wherein the first wall defines a first diameter and the second wall defines a second diameter greater than the first diameter.

8. The mounting system of claim 1, wherein the first engagement surface is convex and the second engagement surface is concave.

9. The mounting system of claim 1, wherein the first engagement member is threadedly coupled to the first leg.

10. The mounting system of claim 9, wherein the second engagement member is threadedly coupled to the second leg.

11. The mounting system of claim 1, wherein the first and second engagement members are operable to bias the first leg away from the second leg.

12. The mounting system of claim 1, wherein the first leg defines a third aperture and the second leg defines a fourth aperture, the mounting system further comprising:

a third engagement member disposed within the third aperture and having a third engagement surface; and a fourth engagement member disposed within the fourth aperture and having a fourth engagement surface configured to receive the third engagement surface.

13. The mounting system of claim 12, wherein the first engagement member extends along a first axis, the second engagement member extends along a second axis, the third engagement member extends along a third axis, and the fourth engagement member extends along a fourth axis, and wherein the first axis is collinear with the second axis, and the third axis is collinear with the fourth axis.

14. The mounting system of claim 13, wherein, in a first orientation, the first leg is separated from the second leg by (i) a first distance along the first and second axes and (ii) a second distance along the third and fourth axes, the first distance being equal to the second distance.

15. The mounting system of claim 14, wherein, in a second orientation, the first leg is separated from the second leg by (iii) a third distance along the first and second axes and (iv) a fourth distance along the third and fourth axes, the third distance being equal to the fourth distance, and the third and fourth distances being greater than the first and second distances.

16. A firearm mounting system comprising:

a bracket having a first leg, a second leg, and a bridge portion, the first leg defining a first aperture concentrically surrounding a first axis and defining a first diameter, the second leg defining a second aperture concentrically surrounding a second central axis collinear with the first central axis and defining a second diameter greater than the first diameter, the bridge portion extending between the first leg and the second leg to define a channel extending between the first leg, the second leg, and the bridge portion;

a first engagement member extending along a third axis; and a second engagement member extending along a fourth axis collinear with the third axis, wherein an end of the first engagement member is configured to axially abut an end of the second engagement member in a non-threaded engagement and thereby configured to impart an axial force.

17. The firearm mounting system of claim 16, wherein the first engagement member includes a first engagement surface symmetrically disposed about the third axis and the second engagement member includes a second engagement surface symmetrically disposed about the fourth axis.

18. The firearm mounting system of claim 17, wherein the third and fourth axes are collinear with the first and second axes.

19. The firearm mounting system of claim 17, wherein the first engagement surface is convex and the second engagement surface is concave.

20. A method of operating a mounting system for a firearm, the method comprising:

positioning a first fastener within a first aperture of a first leg;

positioning a second fastener within a second aperture of a second leg, the second leg being opposite the first leg;

engaging the first fastener with the second fastener such that the first fastener is in a non-threaded engagement with the second fastener;

applying a first force on the first leg with the first fastener;

applying a second force on the second leg with the second fastener, the second force being opposite the first force;

positioning the first fastener within the first aperture and within the second aperture;

applying a third force on the first leg with the first fastener, the third force being opposite the first force; and applying a fourth force on the second leg with the first fastener, the fourth force being opposite the second force.

* * * * *